United States Patent [19]

Sanders

[11] 4,032,415

[45] June 28, 1977

[54] METHOD FOR PROMOTING REDUCTION OXIDATION OF ELECTROLYTICALLY PRODUCED GAS

[75] Inventor: Frederick W. Sanders, Chillicothe, Ohio

[73] Assignee: The Mead Corporation, Dayton, Ohio

[22] Filed: Sept. 30, 1976

[21] Appl. No.: 728,152

Related U.S. Application Data

[62] Division of Ser. No. 498,084, Aug. 16, 1974, Pat. No. 3,996,118, which is a division of Ser. No. 252,285, May 11, 1972, Pat. No. 3,849,278.

[52] U.S. Cl. ..... 204/78; 204/91; 204/103; 204/128; 204/130

[51] Int. Cl.[2] ..... C25B 4/02; C25B 1/26

[58] Field of Search ..... 204/78, 91, 103, 128, 204/130

[56] References Cited

UNITED STATES PATENTS

| | | | |
|---|---|---|---|
| 3,645,863 | 2/1972 | Stewart et al. | 204/59 F |
| 3,966,571 | 6/1976 | Gagnon et al. | 204/130 |
| 3,970,531 | 7/1976 | Recht | 204/130 |

*Primary Examiner*—R. L. Andrews
*Attorney, Agent, or Firm*—Biebel, French & Nauman

[57] ABSTRACT

Gaseous products which tend to form at the anode or cathode of an electrolytic or electrochemical system in which the electrolyte is an aqueous medium may be converted into a reduction-oxidation reaction product through the action of a Contacogen. In such electrolytic systems, hydrogen is usually produced at the cathode and oxygen or other gas may be produced at the anode. By placing a Contacogen in gas receiving relation with the electrode at which a gas tends to be produced, and externally introducing a second gas into contact with the electrode gas and the Contacogen in the presence of an aqueous medium, the two gases enter into a reduction-oxidation reaction to produce a product which is electrolytically noninterferring. The Contacogen is particulate in nature and maintained in a static condition and forms the situs of reaction between the two gases in the presence of an aqueous medium. The Contacogen is wetproofed to prevent flooding thereof by the aqueous medium and operates to increase the rate of reaction between the gaseous reactants in the aqueous medium over the possible at room temperatures and pressures absent the Contacogen. Thus the present invention provides a novel method and apparatus for substantally eliminating one or more gaseous products formed in electrolytic systems having an aqueous medium as the electrolyte.

3 Claims, 5 Drawing Figures

METHOD FOR PROMOTING REDUCTION OXIDATION OF ELECTROLYTICALLY PRODUCED GAS

CROSS-REFERENCE TO RELATED APPLICATION

This application is a division of pending application Ser. No. 498,084, filed Aug. 16, 1974, now U.S. Pat. No. 3,996,118, filed Aug. 16, 1974, which in turn is a division of application Ser. No. 252,285, filed May 11, 1972 now U.S. Pat. No. 3,849,278, filed May 11, 1972.

BACKGROUND OF THE INVENTION

This invention relates to electrolytic and electrochemical systems, apparatus and methods in which electrolytic reactions are carried out in an aqueous electrolyte and wherein there is a tendency to produce a gas, at least at the cathode. Specifically, the present invention relates to an improved electrolytic system in which gas which tends to form at one of the electrodes is reacted and removed preferably in the form of an electrolytically non-interfering oxidation-reduction reaction product. Important in the practice of this invention is a Contacogen which is the situs of the oxidation-reduction reaction between the gas tending to form at either electrode and a second gas introduced and brought into contact with the Contacogen to effect a reduction-oxidation reaction of the gas formed at the electrode, or tending to form at the electrode. The Contacogen is preferably in the form of particulate wetproofed material maintained in a static condition, as opposed to percolating or in turbulent movement, and simultaneously contacted by an aqueous media, and the reactants. In this way, the gas, if formed, is effectively eliminated.

DESCRIPTION OF THE PRIOR ART

Electrolytic processes are known in which an aqueous electrolyte is contacted by an anode and a cathode and wherein hydrogen is produced at the cathode (the electrode at which reduction takes place) while chlorine or oxygen or other gas may be formed at the anode (the electrode at which oxidation takes place). In these prior art systems, the production of one or the other of the gases at the cathode or anode presents practical problems. For example, U.S. Pat. No. 3,203,882 of Aug. 11, 1965, describes a bipolar chlorate cell used in the manufacture of alkali metal chlorate from alkali metal chloride solutions and wherein the cover of the cell acts as a collector for gases generated during electrolysis. The formation of hydrogen, oxygen and chlorine is said to present a problem of explosion. Reference is also made to U.S. Pat. No. 2,797,192 of June 25, 1957 and U.S. Pat. No. 3,463,722 of Aug. 26, 1969, in which the gases produced and the ratio thereof is described.

Another example of an electrolytic process of the type to which this invention applies is the production of chlorine and alkali in what is usually referred to as a "chlor-alkali" cell. The electrolyte is sodium chloride brine, with chlorine gas produced at the anode and hydrogen gas and sodium hydroxide produced at the cathode, the anode and cathode are usually separated by a membrane or diaphragm. Canadian Pat. No. 700,933 of Dec. 29, 1964, describes such a system wherein the cathode is in the form of a porous carbon member through which air or oxygen is introduced, the purpose, according to said patent, being to effect reaction between the cathodic gas product and oxygen and thereby to convert the usual cathode to a fuel cell type cathode. Also disclosed by this Canadian patent is the use of a slurry of particulate solids in the catholyte, the slurry being freely movable in the catholyte to contact the cathode proper. When particulate solids are used in the catholyte, they may be graphite or carbon impregnated with a metal catalyst, or metal particles, the particulate material being small enough to form an aqueous slurry which when aerated allows for free and rapid contact of such particles with the cathode. In one form, the catholyte particles may be partially coated with a hydrophobic material such as tetrafluoroethylene, silicones, etc. The conductive particles are said to act as absorbents or collectors for oxygen admitted and hydrogen evolved in the cathodic portion of the cell, and are said to accept electrons upon contact with the cathode which dissipates as they move through the electrolyte with the formation of hydroxyl ions or other hydrogen-oxygen ions and ultimately water. The data presented in this Canadian patent indicates that the presence of particulate material as a slurry in the catholyte does not significantly improve the performance of the cell as compared with operation absent the slurry. Here reference is made to a comparison of 105 Ma at 1.68 v absent the slurry vs. 110 Ma at 1.8 v with the slurry present.

It is known in the art that air or oxygen may be used to depolarize a cathode. U.S. Pat. No. 3,124,520 of Mar. 10, 1964, describes a porous graphite cathode in a caustic-chlorine diaphragm cell in which air or oxygen is introduced into the porous cathode. This method of depolarization is criticized not only because of the absence of an oxygen-to-hydroxyl ion catalyst in the electrode, but because of the nature of the catholyte which is NaOH-NaCl. Thus, it is suggested that a cation exchange membrane be used to separate anolyte and catholyte in order to form NaOH in the catholyte, and that the cathode contain a catalyst. Also disclosed is a hydrogen anode, i.e., a porous anode into which hydrogen gas is introduced in order to react with the oxygen which may be released at the anode.

U.S. Pat. No. 3,219,562 of Nov. 23, 1965, also describes the "fuel cell reaction", that is, the introduction of oxygen at the cathode which is wetproofed and which has a potential applied thereto in order to effect reduction of the oxygen by acceptance of electrons and the formation of water by reaction with hydrogen ions in the catholyte. The cathode is a porous plate impregnated with platinum and wetproofed with polytetrafluoroethylene. In one form, the cell is operated as a fuel cell with a load connected between the anode and cathode and wherein the two electrodes are separated by an ion exchange membrane, olefinic gas being introduced into the anolyte. In another form the cell is electrolytic with hydrogen released at the cathode.

U.S. Pat. No. 3,147,203 of Sept. 1, 1964, which relates to the production of carbonyl compounds from olefin feed stock, describes a fuel cell system in which oxygen is introduced into the cathode and olefin fuel gas at the anode, with power being generated.

U.S. Pat. No. 3,216,632 describes a bipolar cell for use in electrolysis in which the bipolar electrode is vertically above the anode, with the cathode portion of the bipolar electrode facing the anode and the anode portion thereof facing the cathode electrode. Hydrogen produced at the lowermost cathode diffuses through the cathode portion of the bipolar electrode and combines with oxygen at the anode portion to form water. The hydrogen released at the cathode electrode is withdrawn.

U.S. Pat. No. 2,390,591 of Dec. 11, 1945, relating to an electrolytic system for the production of oxygen gas from caustic alkali or acid solutions describes introducing air into a porous carbon cathode for the purpose of depolarizing the same. U.S. Pat. No. 3,143,698 of May 26, 1964, relates to a primary cell in which a tribromide is used to depolarize the cathode. Both oxidizing depolarizes (chlorine and oxygen introduced at the cathode) and reducing depolarizers (acetylene, etc., introduced at the anode) are disclosed.

Depolarization of an electrode by a gas is sometimes used to measure the concentration of the gas, see U.S. Pat. No. 3,247,452 of Apr. 19, 1966, wherein the change in voltage or current effected by depolarization is measured. Reference is also made to U.S. Pat. No. 3,258,415 of June 18, 1966, which uses a porous cathode and in which the depolarizing gas, and the gas being measured, is oxygen.

The use of electrolytic systems for the regeneration of ferricyanide-bromide bleach baths in photographic processing is known, see British Pat. No. 801,106, published Sept. 10, 1958.

Other patents of interest are: U.S. Pat. Nos. 524,229 of Aug. 7, 1894; 524,291 of the same date, and 530,867 of Dec. 11, 1894 all dealing with primary batteries. Also of interest is U.S. Pat. No. 2,010,608 of Aug. 6, 1935 dealing with a gas permeable carbon electrode for use in an air depolarized cell in which the electrode is impregnated with a solution of oil, paraffin, or the like.

It is known from texts (Electrochemistry, Potter, MacMillan Co., New York 1956) that cathodic hydrogen evolution involves overall $$2H^+ + 2e \rightarrow H_2.$$

Several steps are said to be involved including:

a. Migration, diffusion or travel by convection of the hydrated hydrogen ion from the bulk liquid to the cathode;
b. A discharge, dehydration reaction in which the hydrated hydrogen ion picks up an electron from the cathode and an H atom is adsorbed on the electrode with formation of water;
c. Combination of adsorbed H atoms with release of $H_2$ gas; and
d. Reaction between the hydrated hydrogen ion, adsorbed hydrogen and an electron to form hydrogen gas.

The overpotential arising from (b), (c) and (d) is usually referred to as the activation overpotential while that from (a) is the concentration overpotential. In depolarization, adsorbed hydrogen atoms react with oxygen to form water. There is a distinction between the hydrogen evolution reaction and the hydrogen discharge reaction as follows:

From hydrogen ions:

(1) Evolution $2H^+ + 2e \longrightarrow H_2$ (2) Discharge $4H^+ + O_2 + 4e \longrightarrow 2H_2O$ From water:

(3) Evolution $2H_2O + 2e \longrightarrow H_2 + 2OH^-$ (4) Discharge $2H_2O + O_2 + 4e \longrightarrow 4OH^-$ Thus, the classic depolarization reaction of the cathode involves reaction (2). Where hydrogen gas has been formed, it is usually removed as a gas. In the "fuel cell cathode", depolarization is effected by the use of air or oxygen on a porous cathode as per equation (2) supra where the hydrogen is in ionic form and adsorbed on the cathode surface.

SUMMARY OF THE INVENTION

The present invention relates to electrolytic systems and offers advantages over the systems of the prior art. Specifically the present invention utilizes a Contacogen, preferably in the form of particulate material wetproofed to prevent flooding thereof, which is maintained in a static condition and simultaneously contacted by the reactants and an aqueous media and which forms the situs of an oxidation-reduction reaction between the reactants. The Contacogen, when used in conjunction with an electrolytic system and as hereinafter defined, operates to remove gas formed at one of the electrodes, e.g., the cathode. It is not necessary for the Contacogen to be in contact with the electrode to function in the manner contemplated by the present invention, although it may be. The electrode, e.g., anode or cathode need not be porous as is required in prior art fuel cell electrodes, especially cathodes which are depolarized by the use of air or oxygen which is forced through the pores of the cathode. It is understood, however, that the Contacogen may be used in conjunction with a porous or foraminous electrode, in which event the externally supplied reactive gas need not be forced through the electrode pores as is required, for example in "fuel cell cathodes".

The type of reaction conditions with which the present invention is concerned are especially suited for Contacogen used because the reaction involves the controlled contact in a liquid phase of two gas reactants in which the contact between reactants is primarily at an interface of the Contacogen and the gases and liquid, the latter restricted contact being an essential aspect of the system of this invention. This controlled contact is in contradistinction to intermixing of the reactants as bubbles of gas in a liquid, as by a diffuser, and the reaction is carried out at that locus of contact between the liquid and gases, and the Contacogen. For the purpose of simplification, and to identify the process of this invention and the essential elements thereof, the term Contacogen is used to mean the solid material which forms the locus of the interfacial contact for the gases and liquid and which should be simultaneously contacted by each of them to produce the desired reaction.

Since the reaction zone involves two gases and a liquid, and the Contacogen, the Contacogen must be in contact with the gases and wetted by the liquid but not flooded by either. Wetted, as used here, means that the contact angle between the Contacogen and the liquid is low, e.g., less than about 90° and approaching zero. If the contact angle is high, e.g., greater than about 90° and approaching 180°, then the liquid will tend to draw away from the surface of the Contacogen, and the surface of the Contacogen is in effect in substantial contact only with the gas, that is, flooded by the gas. On the other hand, with the surface of the Contacogen readily wetted by the liquid, that is, with a contact angle approaching zero between the Contacogen surface and the liquid, the liquid will tend to cover the surface of the Contacogen, and the surface of the Contacogen is in effect in substantial contact only with the liquid, that is, "flooded" by the liquid. As a practical matter the primary source of flooding is the liquid medium present. One method of preventing flooding, usually by the liquid is by treatment of the Contacogen which is designated as "wetproofing". This adds to the Contacogen a minor proportion of an inert substance not wetted by the liquid, that is, the contact angle between this inert additive and the liquid is greater than about 90°.

The Contacogen in accordance with the invention, is a solid which is essentially inert with respect to the gases, the liquid, and the products in the sense that it is not attacked in the sense that it is physically consumed or degraded. A material having a high surface-area-to-weight ratio is preferred because it furnishes greater interfacial contact. In addition, the Contacogen is structured to promote simultaneous contact with both the gases and liquid and may be in various physical forms to accomplish this purpose. In the case of a Contacogen in particulate form, the particles are structured to provide a large surface area, for example, the particles are individually nonporous solids of large surface area, or they may be structured to form larger particles which are porous.

In the base of porous materials used as a Contacogen, it will be understood that neither the liquid nor the gaseous reactants should be forced through the pores of the Contacogen in the sense that a porous member is used as a diffuser to form small bubbles of one reactant which are in intermixing contact with the other reactant.

Various solid material may be used as a Contacogen and carbon, activated carbon, platinized materials are preferred. Of the above materials, carbon and activated carbon appear to provide optimum performance because of the relatively large surface-area-to-weight ratio obtainable, as well as the degree to which carbon may be finely divided. Moreover, this is a readily available material which may be obtained in a wide variety of particle sizes and surface areas. Carbons from different sources often result in different reaction rates. These variations are easily determined by simple procedures. Typical of the carbons usable in accordance with the present invention are carbon black, furnace black, channel black or carbons prepared by known procedures from various sources, for example, wood, corn cobs, beans, nut shells, bagasse, lignin, coals, tars, petroleum residues, bones, peat and other carbonaceous material.

The particle size may vary from 9 millimicrons to relatively large size, e.g., 1 inch or more, and usually the carbon is supplied as a mixture of various particle sizes. The surface area of the carbonaceous material may vary from 3 square meters per gram to in excess of 950 square meters per gram, as characterized by gaseous absorption using the BET method.

Carbon may be wetproofed as follows:

Polytetrafluoroethylene (PTFE) in emulsion form is intermixed with particulate carbon in an amount of between 0.1% to 100% based on carbon solids. The mixture is heated to remove the vehicle and dispersing agent for the PTFE. For further description of Contacogen and wetproofing, reference is made to Ser. No. 87,503, filed Nov. 6, 1970.

The Contacogen of the present invention does not act as an absorber of the released gas or of the externally supplied gas, nor does the effectiveness of the Contacogen depend upon transfer of electrons from the cathode to Contacogen brought into contact with the cathode or other electrode.

In the case of evolved hydrogen, it is difficult to convert the formed gas into water because of the presence of an aqueous medium which slows down the reaction of $$O_2+2H_2 \rightarrow 2H_2O$$

By the present invention, gaseous oxygen and hydrogen are reacted in the presence of a Contacogen and an aqueous medium to form water, the rate of reaction being significantly faster in an aqueous medium and a Contacogen than in an aqueous medium without a Contacogen. Whether classic depolarization of the cathode is accomplished in not entirely clear, especially since the depolarizing gas is not introduced into the cathode itself as is the base in the prior art. In the case of alkaline solution, the discharge step is said not to involve a hydrogen ion because the standing concentration of such ions in alkaline solutions is small. In alkaline solutions, it is believed that the discharge takes place from the water molecule, while the secondary discharge involves the water molecule in alkaline solution.

By the use of a Contacogen in accordance with this invention, wherein the Contacogen is maintained in a static condition in the bulk catholyte adjacent to the cathode, a reduction in power is sometimes observed. Whether this is attributable to offsetting of the water discharge reaction, or offsetting the primary or secondary discharge reaction in alkaline media is not really known with certainty.

Thus, the present invention is primarily useful in electrolysis systems in which an aqueous electrolyte is used, for example:

a. Chlorate production from aqueous sodium chloride;
b. Chlor-alkali cells for production of chlorine and sodium hydroxide;
c. Conversion of sodium or potassium ferrocyanide in aqueous solution to the corresponding ferricyanide;
d. Conversion of aqueous sodium sulfide to sodium polysulfide and alkali;
e. Conversion of aqueous systems to produce high purity oxygen; and
f. Conversion of sodium thiosulfate to sodium sulfate.

The above are merely representative to the electrolysis systems with which the present invention may be used. Each of these conversions is electrolytic in nature and characterized by formation of a gas at one electrode, usually hydrogen at the cathode, and sometimes oxygen or chlorine or both at the anode. In the usual case, however, the gases at the anode are the desired products whereas the gas at the cathode is hydrogen and presents problems due to explosion and the like.

The present invention is directed to overcoming the problem of gas production, especially at the cathode, by reacting the formed gas to eliminate its presence. This is accomplished by use of a Contacogen which is maintained in a static nonturbulent, non-percolating condition and simultaneously in contact with an aqueous medium, usually the electrolyte, and also in contact with a reducing or oxidizing gas externally applied for reaction at the Contacogen with the reactive species at or in the vicinity of the electrode. The Contacogen, in accordance with this invention is a particulate material in which each granule is wetproofed to prevent flooding by the aqueous medium so that substantially each granule is simultaneously contacted by the reactants and the aqueous medium but not flooded by any one of them.

Depending on the mode of operation, the Contacogen may be in close proximity to the electrode or removed therefrom and in communication with the gas produced at the electrode. In this mode, the Contacogen operates to accelerate the reaction between two gases in an aqueous medium conditions that normally inhibit gas-gas reactions.

Accordingly, it is a primary object of the present invention to provide a simple efficient system for reacting gases which tend to be produced at an electrode during an electrolytic process in which an aqueous electrolyte is used, and wherein the reaction by which such product is removed is an oxidation-reduction reaction involving a Contacogen to produce a reaction product which is electrolytically non-interferring with the electrolytic system.

Another object of the present invention is the provision of an improved system useable in electrolytic processes including an aqeuous electrolyte by which the gas produced at the cathode is reacted with an oxidizing gas introduced into a Contacogen which is simultaneously contacted by an aqueous liquid, which may be the same or different from the electrolyte, and also contacted by the oxidizing and reducing gas for reaction therebetween in the presence of the Contacogen which is maintained in a static condition and wetproofed with respect to the aqueous medium to prevent flooding thereby.

Another object of the present invention is the provision of an improved electrolytic system wherein there is a tendency for hydrogen gas to be produced at the cathode, and wherein a Contacogen is positioned to receive the gas formed at the cathode and wherein an oxidizing gas is introduced into the Contacogen to react with the hydrogen gas, in the presence of an aqueous medium, to convert the hydrogen gas to an oxidized product as water or hydroxyl ions.

Another object of the present invention is the provision of an electrolytic system of the type described wherein a Contacogen is placed in the vicinity of a gas producing electrode and contacted but not flooded by an aqueous electrolyte and wherein a second gas is introduced into the Contacogen for the purpose of entering into an oxidation-reduction reaction with the species produced at the electrode.

Another object is the provision of an improved electrolytic system for the oxidation of an alkali metal ferrocyanide to an alakli metal ferricyanide.

Other objects and advantages of the present invention will be apparent from the following description, the accompanying drawings and the appended claims.

DESCRIPTION OF THE INVENTION

The present invention will be described using the oxidation of an alkali metal ferrocyanide to an alkali metal ferricyanide. In photographic processing a ferricyanide silver bleach is used in most color reversal processing and in some color negative processing. This is a rehalogenating process in which the ferricyanide oxidizes the metallic silver image to silver ion which, in the presence of a bromide salt such as sodium bromide produces a water insoluble silver bromide salt. The basic reactions are:

$$K^+ + Ag^\circ + K_3Fe(CN)_6 \rightleftharpoons Ag^+ + K_4Fe(CN)_6$$

$$Ag^+ + NaBr \rightleftharpoons Ag\,Br + Na^+$$

The bleach bath is followed by a sodium thiosulfate fixing bath which forms a water soluble silver complex. As indicated, the reactions are reversible and the buildup of ferrocyanide does not have appreciable adverse affect on bleaching time, the latter being a function of the decrease in ferricyanide concentration. Ferricyanide is one of the more expensive inorganic chemicals used in reversal color photographic processing, and its regeneration from ferrocyanide has economic value. Some of the known regenerating schemes include oxidation by bromine, oxidation by persulfate, oxidation by ozone and air oxidation. While these systems in the main are operative and have been used before there are drawbacks, e.g., bromine vapors, excessive persulfate creates acid pH with the formation of Prussian blue and free cyanide, potential health and explosion hazards of ozone, and the slowness of air oxidation.

Figure 1:
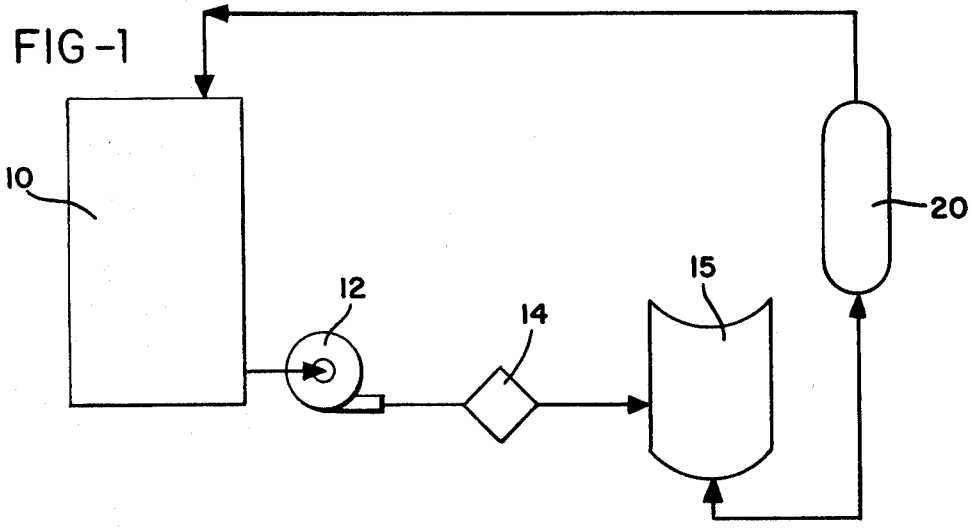
FIG. 1 is a schematic view of an overall electrolytic system in accordance with the present invention.

Referring to FIG. 1, a portion of a continuous photographic processing system is shown, i.e., a bleach tank 10 through which photographic film is treated on a continuous or batch basis with a bleach solution. Typical such processes are the EA-4, ME-4, E 2, E 3, E 4 and EA-5 processes of Eastman Kodak or the AR-1 Ansco process. The bleach solution itself is a mixture of 43 to 54 g/l of sodium bromide, about 130 g/l of potassium ferricyanide, containing borax as a buffer, a nitrate for corrosion inhibition, fungicides and polyethylene glycol of molecular weight between 1540 to 4000. The bleach compositions are themselves well known. Bleach from the tank 10 is pumped via pump 12 through a filter 14 to a heat exchanger 15 and then to an electrolytic unit 20. The output of the electrolytic unit 20 is then returned to the bleach tank 10.

Figure 2:
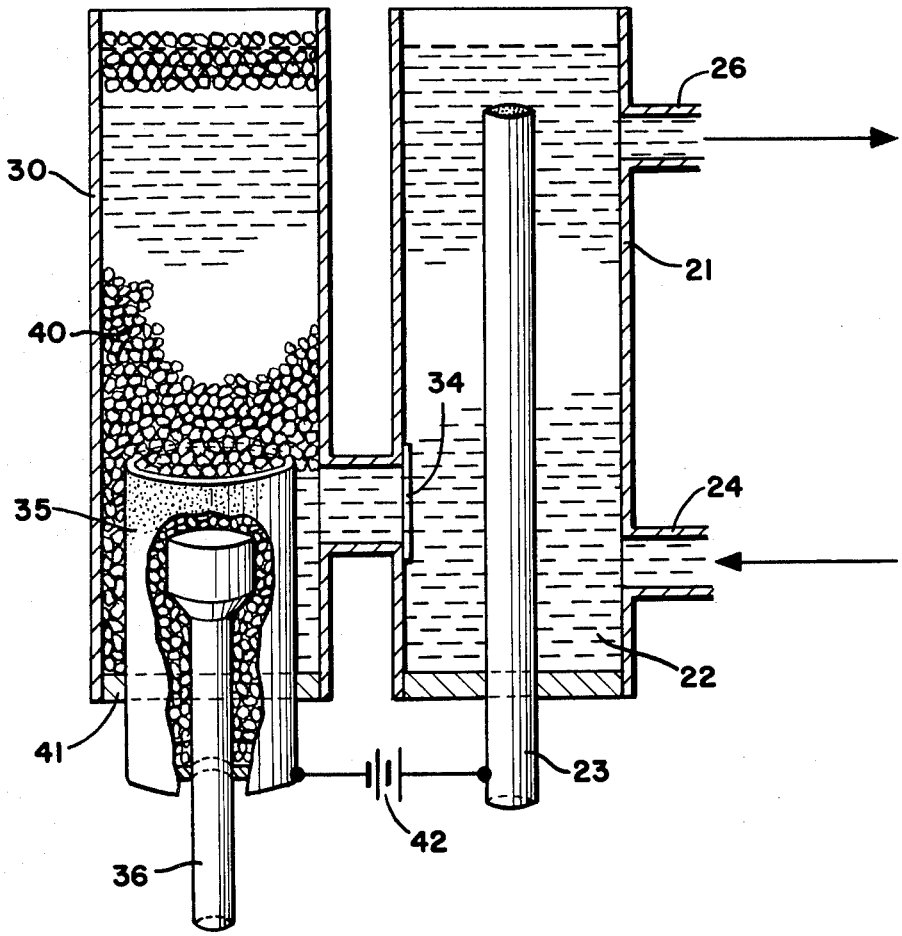
FIG. 2 is a view, partly in section and partly in elevation with portions thereof broken away, of an electrolytic cell in accordance with the present invention.

In the electrolytic unit 20, potassium ferrocyanide is oxidized to the ferricyanide state at the anode and there is reduction at the cathode which tends to produce hydrogen. Referring to FIG. 2, a typical electrolytic cell 20 of the present invention is shown for converting ferrocyanide to ferricyanide. The cell includes an anode compartment 21 containing the anolyte 22 in contact with an anode 23 of carbon, the anolyte being used bleach solution from the heat exchanger introduced into the anode compartment by inlet 24, oxidized anolyte leaving through outlet 26 and to flow back to the bleach tank.

Cooperating with the anode chamber is a cathode chamber 30 separated from the cathode chamber by a cation exchange membrane 34. The cathode chamber 30 includes a cathode 35 in the form of a non-porous carbon tube, in the center of which is positioned a diffuser 36 for introduction of an oxidizing gas such as air or oxygen. The cathode chamber contains a catholyte, e.g., spent bleach solution which during the course of electrolysis increases in concentration of ferrocyanide in that ferricyanide is reduced at the cathode. Also contained in the cathode chamber is a Contacogen 40 in the form of granular particulate material wetproofed, as described, and maintained in a static condition. As shown the Contacogen 40 substantially fills the cathode compartment and is supported in the electrolyte by base 41 of the cathode compartment through which the cathode extends. A power supply 42 is attached across the anode and cathode as shown.

In typical runs, the apparatus shown in FIG. 2 operated as follows: Bleach solution was pumped into the anode compartment at the rate of 25 cc/min. and the potential between the electrodes was maintained at 5 volts, the current being allowed to fluctuate.

The data based on three hours running time is as follows:

rate of 500 cc/min. will be capable of oxidizing twice the required amount of ferrocyanide per minute.

It has also been observed with the apparatus of FIG. 2, that the pH at the cathode increases substantially, i.e., 14 while the pH at the anode decreases to an acidic condition, a condition which favors oxidation of ferro-to-ferricyanide. Moreover, the volume of water at the cathode does not appreciably increase. These observations tend to support the proposition that the use of an oxidizing gas results in formation of hydroxyl ions which unite with sodium and/or potassium ions coming into the catholyte through the membrane thereby forming sodium and potassium hydroxide. The source of the sodium is from the consumption of bromide by the film. In this particular case, the species formed by oxidation is believed to be hydroxyl ions, an electrolytically non-interfering material which is the oxidation-reduction reaction product. Regardless of the explanation, the fact remains that no gaseous hydrogen is evolved at the cathode, an imperforate electrode.

During operation of the unit, the ferricyanide level in the cathode was maintained above 10% and the ferrocyanide below 90% since performance of this unit seemed more efficient under these conditions. It was also observed in the absence of an oxidizing gas in the cathode and absent the Contacogen, that hydrogen was produced at the cathode.

The apparatus previously described may, in accordance with the present invention, take other forms.

| | Run | | | | |
|---|---|---|---|---|---|
| | 1 | 2 | 3 | 4 | 5 |
| Flow rate - air | 25cc/min. | 25cc/min. | 25cc/min. | 25cc | 25cc |
| Temperature | 30° C | 30° C | 40° C | 50° C | 50° C |
| pH | 8 | 6 | 7 | 8 | 6 |
| Rate of ferricyanide increase | $4.3 \times 10^{-5}$ moles/min. | $3.3 \times 10^{-5}$ m/min. | $6.5 \times 10^{-5}$ m/min. | $4.2 \times 10^{-5}$ m/min. | $8.5 \times 10^{-5}$ m/min. |
| Concentration of ferrocyanide | | | | | |
| start | .061m | 0.58m | 0.60m | .060m | .059m |
| Finish | .052m | .046m | .048m | .051m | .043m |
| Concentration of ferricyanide | | | | | |
| start | .340m | .362m | .350m | .362m | .372m |
| Finish | .366m | .366m | .372m | .372m | .388m |

For the configuration shown in FIG. 2, the preferred operating conditions are 50° C and pH 6.0.

In a typical bleach operation, bleach recirculation rate is 10 liter/min. of a tank having a 16 liter capacity. The increse in ferrocyanide due to processing of film is 1.1 grams/liter or 11 grams per 10 liters. If the nominal ferrocyanide concentration in the tank 10 is 0.45 grams/liter, conversion of ferrocyanide to ferricyanide at a rate of $2.85 \times 10^{-2}$ moles/min. or 1.2 grams/1-min. would maintain this nominal ferrocyanide concentration, i.e., the ferrocyanide concentration would not build up. In the runs described, the surface area of the anode was 0.05 $ft^2$ at an average current of 1.05 amps or a current density of 21 amp/$ft^2$ at a calculated electrical efficiency of 96%.

In order to understand better the performance of the system of the present invention, the design parameter is established such that up to 90% of the bleach solution can be recycled. For example, ferrocyanide is produced at the rate of 0.0016 moles per square foot of film processed, using the MF-4 process. Motion picture film running at 60 feet/min. involves 6.88 $ft^2$ of film/-min. and requires the oxidation of 0.011 mole of ferrocyanide per min. To achieve this rate of oxidation, 0.0275 moles of oxygen or air at the rate of 3,060 cc/min is required. A unit in accordance with the present invention having a capacity of 15 liters and a flow Referring to FIG. 3 an electrolytic photographic bleach generating unit 50 is shown including an annular electrically insulating support housing 51 receiving an annular anode 53 of 5 mil. thick tantalum. The active surface of the anode is the interior surface 54. The lower end of the housing is closed by a plug 55 while the lower end of the anode is supported on a manifold plate 56 spaced from the plug 55 by spacer 57 to provide a plenum chamber 58. Used bleach is introduced through an opening 59 in the plug 55, into the plenum 58 and through holes 61 formed in the manifold plate 56 so that bleach flows into contact with the anode surface 54.

Arranged concentrically within and spaced from the anode 54 is a cation exchange membrane 65 which is positioned between two concentrically disposed plastic sleeves 66 and 67. The sleeves are perforated as illustrated to permit contact of the electrolyte with the membrane. The ends of the sleeves 66 and 67 are sealed to their respective supports, manifold plate 56 and an upper end cap 68. Positioned within and spaced from the membrane 65 is an annular cathode 70 of tantalum, supported and centered at the lower end by a boss 71 on the manifold plate 56 and at its upper end by a boss 72 on the end cap. Both surfaces of the cathode 70 are active surfaces. Also positioned on the end cap is a siphon atomizing nozzle 75 having an air inlet 76 and a liquid intake 77 in the form of a hollow tube which extends into the chamber between the cathode and the inside surface of the membrane.

Disposed within the cathode chamber, i.e., on the inside of the tubular cathode and in the space between the cathode and the membrane is Contacogen 80. A typical Contacogen is particulate carbon wetproofed with polytetrafluoroethylene in an amount of 8% by weight and doped with 5% silver.

The volume of the membrane encircled cathode compartment is 2,550 $cm^3$ while the anode compartment is 850 $cm^3$. The area of the electrodes in solution contact, however, is equal. The use of a 3:1 volume ratio assures full compensation for cathodic reduction of ferricyanide since efficiency of the unit may depend on ferricyanide level if the cathode compartment contains a mixture of ferri and ferrocyanide.

In operation, used bleach is introduced at inlet 59 and is distributed into the anode chamber by the ring of openings 61 in the manifold plate 56. The oxidized bleach then flows into a weir 81 for return to the bleach tank from an outlet or drain 82. The interior of the cathode contains a catholyte which may be used bleach which is drawn to the atomizer by arm 77, atomized with air and sprayed into the center of the cathode, the latter provided with holes 83 at the bottom to permit flow of catholyte into the membrane-cathode chamber. Air of reduced oxygen content exits through vent holes 84 in the end cap, which holes can also be used to introduce catholyte into the unit. A potential is applied between the electrodes by a power source 85.

The cell 50 was operated at a flow rate of 10 liter/-min. with a head pressure in the cathode compartment of 20–30 psig due to the atomizing nozzle. In the course of operation, it was observed that tantalum is quite suitable as a cathode, but that an oxide formed on a tantalum anode. The use of a carbon graphite non-porous anode of 4½ ID, 5 inches OD and 10¾ inches long was satisfactory.

Figure 3:
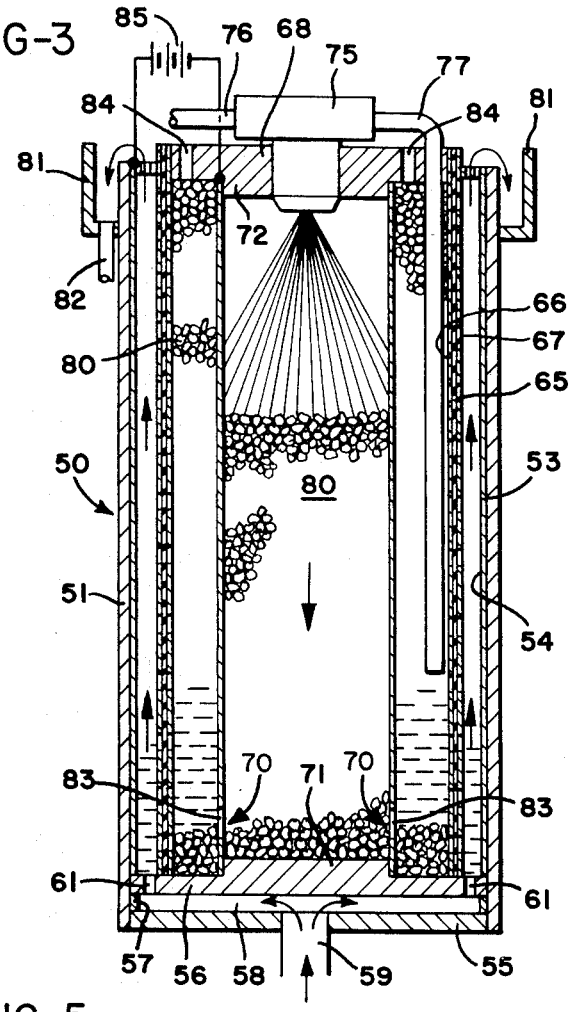
FIG. 3 is a view, partly in section and partly in elevation, of another form of electrolytic cell embodying the present invention.

In typical operations of the apparatus of FIG. 3, anolyte, i.e., used bleach was recirculated at a rate of 1 liter/min., pH 6, at 50° C with 6 volts at 25 amps into the anode compartment. The catholyte was used bleach recirculated in the cathode chamber under 15 psig fluid pressure and atomized under 20 psig of air pressure. The rate of ferrocyanide oxidation in the anolyte was 4–6 g/l/m at an input level of 20 g/l ferrocyanide, 125 g/l ferricyanide and 20 g/l sodium bromide.

The cell of FIG. 3 was operated with bleach flowing through the cell at a prescribed rate, under 50° C constant temperature, while the cathode was operated under conditions described above. Flow rates of 0.5, 1.0, 2.0, and 3.0 liter/minute, were evaluated over a period of time equal to the holding tank volume (16 liters, as is representative of a color Versamat) divided by the flow rate. Four sample sets were pulled at equal intervals of this recycle time period. A sample set consisted of 50 mls taken of influent to the cell and 50 mls of effluent taken X minutes later. The data collected over these four flow rates are presented below.

TABLE I*

| Cell Solution | + 2 Ferro g/l | + 3 Ferri g/l | Na + Br g/l | pH | Time in Min. |
|---|---|---|---|---|---|
| Start-up | 18.5 | 122. | 21.0 | 6.15 | 0 |
| Out | 10.5 | | | 5.7 | 9 |

TABLE I*-continued

| Cell Solution | + 2 Ferro g/l | + 3 Ferri g/l | Na + Br g/l | pH | Time in Min. |
|---|---|---|---|---|---|
| In | 16.8 | | | 5.9 | 8 |
| Out | 9.7 | | | 5.5 | 17 |
| In | 15.2 | 123.5 | 20.8 | 5.7 | 16 |
| Out | 8.4 | | | 5.25 | 25 |
| In | 14.8 | | | 5.50 | 24 |
| Out | 7.6 | | | 5.1 | 33 |
| In | 12.2 | 125.5 | 20.8 | 5.35 | 32 |
| Catholyte | 108.9 | 62.6 | 21.0 | 8.45 | 34 |

*.45 liter/min. Bleach Recycle - 6 volts, 22 amps

TABLE II*

| Cell Solution | + 2 Ferro g/l | + 3 Ferri g/l | Na + Br g/l | pH | Time in Min. |
|---|---|---|---|---|---|
| Start-up | 10.9 | 127. | 14.9 | 5.00 | 0 |
| Anolyte | | | | | |
| Out | 6.8 | | | 4.1 | 4 ½ |
| In | 10.5 | | | 4.95 | 4 |
| Out | 15.5 | | | 3.9 | 8 ½ |
| In | 9.3 | 128. | 13.9 | 4.8 | 8 |
| Out | 15.5 | | | 3.95 | 12 ½ |
| In | 8.4 | | | 4.7 | 12 |
| Out | 5.0 | | | 3.7 | 16 ½ |
| In | 8.0 | 129. | 14.3 | 4.6 | 16 |
| Catholyte | 112.1 | 57.5 | 14.9 | 8.9 | 65 |
| Anolyte | 8.0 | | | 4.8 | 68 |

*.98 liters/min. Bleach Recycle - 6 volts, 20 amps

TABLE III*

| Cell Solution | + 2 Ferro g/l | + 3 Ferri g/l | Na + Br g/l | pH | Time in Min. |
|---|---|---|---|---|---|
| Start-up | | | | | |
| Anolyte | 13.3 | 119. | 19.0 | 6.0 | 0 |
| Catholyte | 109.7 | 53.8 | 20.8 | 8.50 | 0 |
| Out | 12.6 | | | 5.45 | 2 ¼ |
| In | 15.2 | | | 5.72 | 2 |
| Out | 11.8 | | | 5.45 | 4 ¼ |
| In | 13.5 | 113. | 17.9 | 5.60 | 4 |
| Out | 10.9 | | | 5.35 | 6 ¼ |
| In | 12.8 | | | 5.45 | 6 |
| Out | 10.5 | | | 5.35 | 8 ¼ |
| In | 13.5 | 119. | 18.7 | 5.45 | 8 |
| Catholyte | 103.3 | 47.5 | 19.5 | 8.60 | 9 |

*2 liters/min. Bleach Recycle - 6 volts, 20 amps

TABLE IV*

| Cell Solution | + 2 Ferro g/l | + 3 Ferri g/l | Na + Br g/l | pH | Time in Min. |
|---|---|---|---|---|---|
| Start-up | | | | | |
| Anolyte | 12.2 | 119. | 18.7 | 5.60 | 0 |
| Out | 10.5 | | | 5.4 | 1.40 |
| In | 11.8 | | | 5.5 | 1.50 |
| Out | 10.9 | 121.5 | 18.55 | 5.35 | 3.10 |
| In | 11.8 | | | 5.45 | 3.00 |
| Out | 10.1 | | | 5.3 | 4.40 |
| In | 10.5 | | | 5.4 | 4.30 |
| Out | 9.3 | | | 5.3 | 6.10 |
| In | 10.9 | 120. | 18.55 | 5.35 | 6.0 |
| Catholyte | 111.8 | 46.2 | 19.6 | 8.7 | 8.0 |
| Anolyte | 10.1 | 123. | 19.15 | 5.52 | 10.0 |

*3 liters/min. Bleach Recycle - 6 volts, 20 amps

Based on data collected, the following equation was developed as applicable to electrolytic conversion of ferrocyanide to ferricyanide in accordance with this invention:

$$J' = \frac{E}{100} i\,(-.527)/QDT$$

where $J'$ = grams/liter/min ferrocyanide decrease;

$E$ = % electrical efficiency ratio;

$i$ = current in amps;
$Q$ = flow rate (liters/min) through the cell;
$Dt$ = Q/volume of the cell; and
−0.528 is equivalent of ferrocyanide oxidized per minute.

Electrolytic cells in accordance with the present invention for use in conversion of ferrocyanide to ferricyanide can be designed, using the above formula as a guide to size, current efficiency and rates of conversion. For example, a cell for 10 liter/min flow may be operated at 25–30 amps/ft$^2$ and up to 100 amps and under 10 volts D.C.

Variations in the above procedure include using potassium hydroxide as the catholyte rather than used bleach, in which event certain advantages occur. For example, it has been observed in the bleach catholyte that at high pHs there is a tendency for ferrocyanide to be converted to an amine which sometimes produces an odor. By using KOH as the catholyte, and introducing an oxidizing gas into the Contacogen, the amount of NaOH and KOH increases by diffusion of the cations through the membrane to react with the hydroxyl groups apparently formed by the reaction at the Contacogen. While this is not a proven working hypothesis, it does offer an explanation for the marked increase in pH in the catholyte, the absence of released hydrogen gas, and is not inconsistent with observed data.

The above system for oxidation of ferrocyanide to ferricyanide when used as an on-line bleach regeneration system for photographic processing may also be used jointly with a sensing system in which the pH of the regenerated bleach and the concentration of bromide ion are monitored and the bleach has added to it those materials needed to bring it to the proper concentration. While the system above has been explained on the basis of potassium or sodium ferrocyanide conversion to the ferricyanide state, it is understood that iron in an ethylene diamine tetracetic acid ligand could also be processed as described to bring the iron from a plus 2 to a plus 3 state.

With the system above described current densities of 30 amps/sq.ft. ft. have been used without the release of hydrogen gas. Where the pH of the catholyte is above 12 and the catholyte is a mixture of ferro and ferricyanide, cyanate has been produced in the catholyte, and at high air or oxygen flows, primary amines are formed.

Another electrolysis system in which the present invention may be used is in the chlorate cell. Here there are several advantages considering the reactions said to take place at the cathode, e.g., hydrogen gas production, and the anode, e.g., primarily chlorine and oxygen. By use of a Contacogen, as described, at the cathode with the introduction of a gaseous oxidizing gas such as air or oxygen, then an oxidation-reduction reaction takes place at the situs of the Contacogen to convert the hydrogen gas into water or hydroxyl ion. The reaction of hydrogen in the presence of the Contacogen operates to remove hydrogen in gaseous form from the cell and thus greatly reduces the explosion hazard. The Contacogen may be placed in the cell, e.g., in the cathode compartment or the gas formed may be flowed to a reactor wherein the hydrogen gas is reacted with oxygen in the presence of a Contacogen and an aqueous medium.

It is also possible in accordance with the present invention to react the hydrogen of the cathode with the chlorine and oxygen of the anode to form water and hydrochloric acid which are returned to the cell for improved current efficiency as noted in U.S. Pat. No. 3,463,722, supra.

In the case of chlor-alkali cell especially the type in which the anolyte and catholyte are separated by a diaphragm, hydrogen is usually produced at the cathode, along with sodium hydroxide, and chlorine gas is produced at the anode. By using a Contacogen in the catholyte, or in gas receiving relation with the cathode generated gas, the unwanted hydrogen gas is easily eliminated by reaction with an oxidizing gas such as air or oxygen to produce water or hydroxyl ions.

Figure 4:
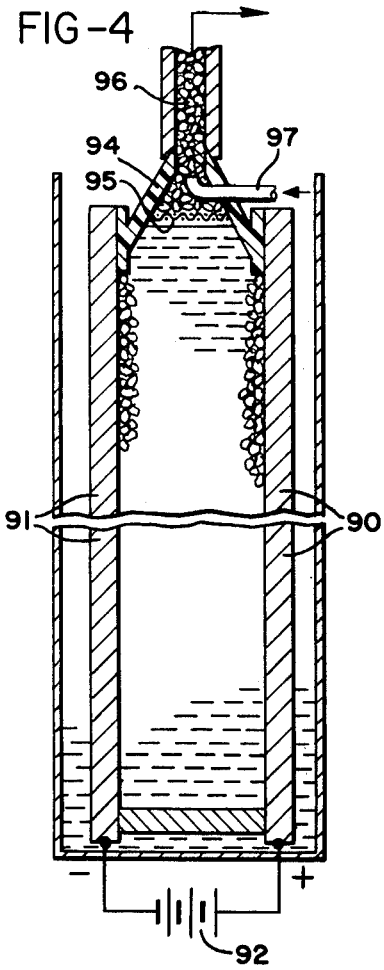
FIG. 4 is a view, partly in section and partly in elevation, of an electrolytic cell of the present invention, in which the Contacogen is positioned out of contact with the electrolyte but in gas receiving relation with the gases produced at the electrodes.

A typical arrangement, in schematic form, for use in a chlorate unit in accordance with this invention is shown in FIG. 4 wherein an anode 90 is shown as spaced from a cathode 91, with a power supply 92 across the two electrodes. Supported above the electrodes and bridging them is a Contacogen support housing and gas collector 94 of polyethylene or the like receiving the hydrogen gas from the cathode and the oxygen and chlorine gas from the anode. Supported by a screen 95 within collector 94 is a Contacogen 96 which is wetted, but not flooded by the water vapor above the electrode. The screen may be of polyethylene of mesh size smaller than the Contacogen granules. As the released gases enter the collector 94 and come into contact with the Contacogen, hydrochloric acid and water are formed by the reaction between hydrogen gas, chlorine and oxygen, the reaction products being returned to the system. Depending on cell operating conditions or concentration, either oxygen, air or a reducing gas may be introduced through inlet 97, as needed, to effect reaction with the reactive species. While the electrodes are shown as anode and cathode, it is apparent that these could be bipolar electrodes with the facing portion being the cathode surface and anode surface, respectively.

Figure 5:
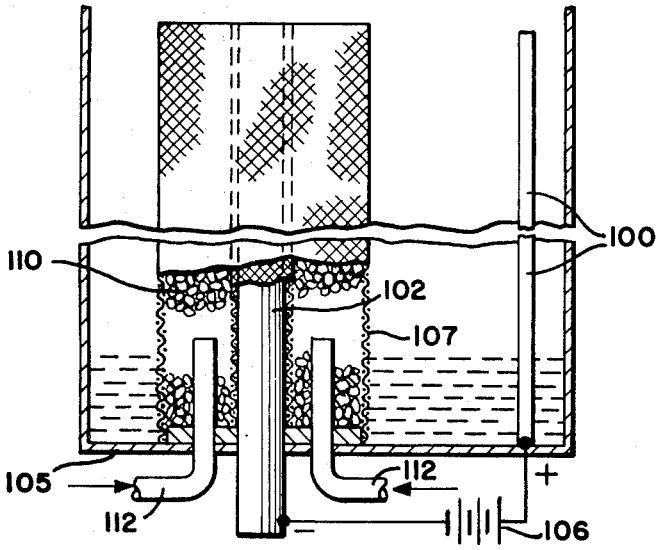
FIG. 5 is a view, partly in section and partly in elevation, of an electrolytic cell in accordance with this invention in which the Contacogen is positioned closely adjacent to the cathode but not in contact therewith.

In another form of the present invention suitable for use as a chlorate or chlor-alkali cell, as shown in FIG. 5, an anode 100 and cathode 102 are supported in spaced relation within a housing 105, current being supplied from a source 106. Surrounding the cathode 102 is a Contacogen support member 107 in the form of an annular polyethylene mesh basket so that the Contacogen is in close proximity to the cathode but electrically isolated therefrom. The mesh is of an open type, the openings in the mesh being smaller than the smallest particle of Contacogen 110 located in the basket 107. Air is introduced into the Contacogen bed through inlet pipes 112, although one may be used if desired, and oxygen may be employed rather than air. Depending on the nature of the catholyte, either hydroxyl ions or water may be formed by reaction between the oxidant gas and cathodically related reactive species. The oxygen produced at the anode may be collected and used as an input gas into the cathode area. As illustrated in FIG. 5, the Contacogen 110 is in contact with the electrolyte, but is not flooded thereby. Since the evolved gas is in an aqueous medium, the rate of reaction is quite low absent the Contacogen. By providing a Contacogen and an oxidant gas, troublesome hydrogen gas evolution is avoided.

The principles of the present invention may also be used in other electrochemical systems in which a gas is produced at one of the electrodes. For example in batteries of the alkaline metal type or of the rechargeable automotive type, using an aqueous electrolyte, the generation of electrical current results in the production of hydrogen gas which is usually vented. By the present invention, a small column of particulate Contacogen may be mounted to receive the hydrogen gas, reacted with oxygen in the form of air to form water which is returned to the battery system.

Various uses of the present invention in electrochemical and electrolytic systems will be apparent to those skilled in the art especially in connection with the handling of gaseous products of the electrochemical or electrolytic system.

While the methods herein described, and the forms of apparatus for carrying these methods into effect, constitute preferred embodiments of the invention, it is to be understood that the invention is not limited to these precise methods and forms of apparatus, and that changes may be made in either without departing from the scope of the invention which is defined in the appended claims.

What is claimed is:

1. In a method of conducting electrolytic reactions by contacting an anode and cathode with an aqueous electrolyte and imposing a current flow from one electrode to the other through the electrolyte thereby producing chlorine gas at the anode, the improvement comprising:

a. positioning a fixed static bed of solid particles selected from the group consisting of carbon particles, activated carbon particles, and platinized compound particles, in a fixed, static condition adjacent the anode so as to receive the chlorine gas electrolytically produced at the anode, b. introducing a second gas capable of reducing said chlorine gas directly into said fixed static bed of solid particles without disrupting the non-turbulent condition of said fixed static bed, and c. introducing an aqueous solution into contact with said solid particles, said solid particles being essentially inert with respect to said chlorine gas, said second gas, said aqueous solution, and the reaction product of said reaction and each solid particle being wetproofed by treatment with a substance not wetted by said aqueous solution in order to effectively promote the non-electrolytic reduction of said chlorine gas.

2. A method as set forth in claim 1 wherein said solid particles are carbon particles wetproofed with a fluorocarbon resin.

3. A method as set forth in claim 1 wherein said solid particles are carbon particles above about 9 millimicrons in size and wetproofed with 0.1 to 100% by weight of said carbon particles of polytetrafluoroethylene resin.

* * * * *